United States Patent [19]

Murray

[11] Patent Number: 4,554,705

[45] Date of Patent: Nov. 26, 1985

[54] ENCAPSULATED FIBERGLASS MOP HANDLE

[75] Inventor: John H. Murray, LaGrange, Ga.

[73] Assignee: Milliken Research Corporation, Spartanburg, S.C.

[21] Appl. No.: 642,557

[22] Filed: Aug. 20, 1984

[51] Int. Cl.[4] ..... B25G 1/10

[52] U.S. Cl. ..... 16/110 R; 16/116 R; 16/DIG. 18; 16/DIG. 19

[58] Field of Search ..... 16/110 R, 111 R, 114 R, 16/116 R, DIG. 18, DIG. 19; 15/143 R, 145

[56] References Cited

U.S. PATENT DOCUMENTS

| | | | |
|---|---|---|---|
| 3,531,822 | 10/1970 | Bush | 16/110 R |
| 3,736,621 | 6/1973 | Szabo | 16/116 R |
| 4,291,998 | 9/1981 | Santos | 16/110 R X |
| 4,466,152 | 8/1984 | Moss et al. | 16/114 R |

*Primary Examiner*—Fred Silverberg

*Attorney, Agent, or Firm*—Earle R. Marden; H. William Petry

[57] ABSTRACT

A handle for use with items, such as mops and brooms, which is encapsulated in a heat shrunk PVC plastic tubing to provide a smooth, protective surface around the handle.

2 Claims, 2 Drawing Figures

ENCAPSULATED FIBERGLASS MOP HANDLE

This invention relates to a new and improved handle for a cleaning utensil such as a broom or mop, etc. which extends the service life of such handle and at the same time protects the hands of the user.

It is therefore an object of the invention to provide a new and improved handle for cleaning equipment such as brooms, mops, floor polishers, etc.

Figure 1:
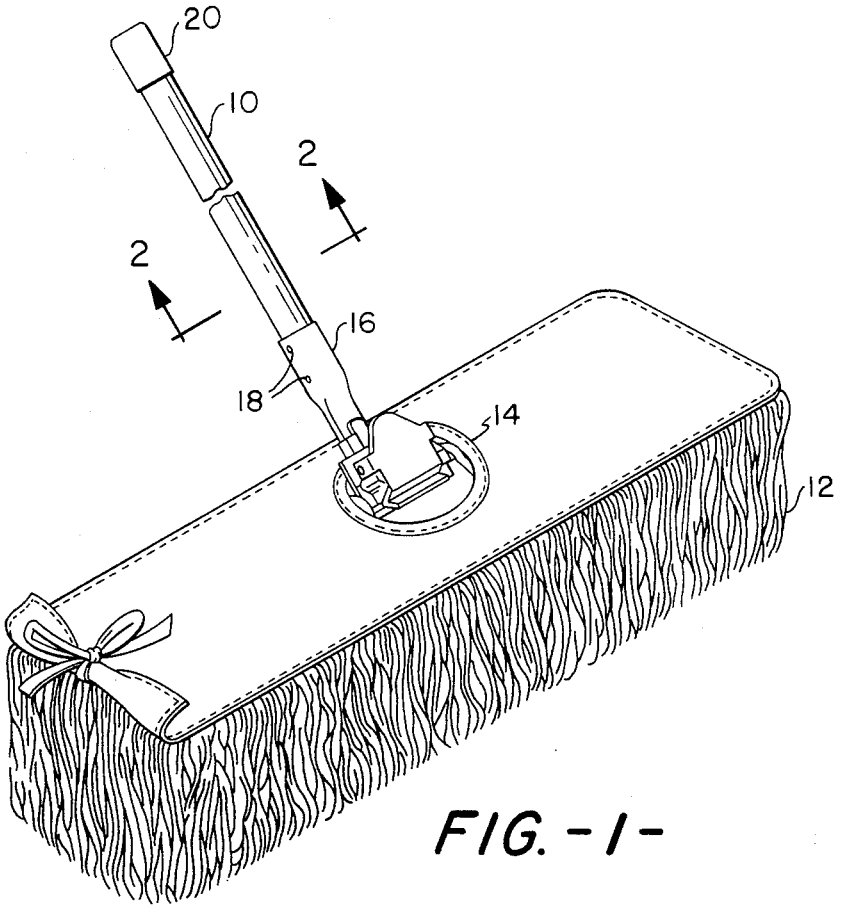
Figure 2:
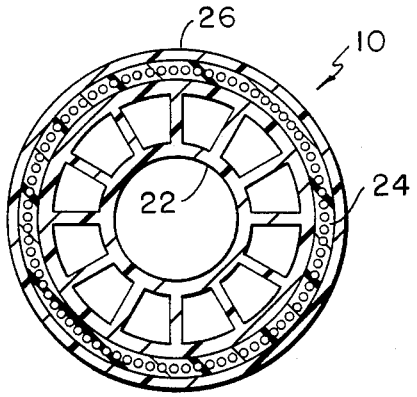

Other objects of the invention will become clearly apparent as the specification proceeds to describe the invention, with reference to the accompanying drawing, in which:

FIG. 1 is a perspective view of the novel handle connected to a floor mop; and FIG. 2 is a cross-section view taken on line 2—2 of FIG. 1.

As pointed out briefly above, the novel handle is preferably used for mops, but obviously, can be employed on any device that a handle is required. Examples of such devices would be brooms, floor polishers, garden tools, paint rollers, and other sundry devices.

Looking now to FIG. 1, the novel handle 10 is shown connected for use with a dust mop 12 through the use of a connecting arrangement 14 described in detail in U.S. Pat. No. 3,029,454. The handle 10 is secured in the hollow connecting collar 16 by suitable connectors or rivets 18. If desired, a suitable end cap 20 can be telescoped over the end of the handle 10.

The handle 10 consists basically of a molded styrene inner core 22, pulltruded outer layer of fiberglass strands held together with an epoxy resin 24 and a heat shrunken PVC plastic tubing 26. In production, the epoxy resin with fiberglass strands 24 is pulled/extruded (pulltrusion) over the inner core 22 to provide a construction which is low in cost, light weight with exceptional bending strength, but is subject to longitudinal cracking from low impact loading in the radial direction resulting in splinters of fiberglass being exposed to the users hands. To correct this deficiency, a PVC plastic tubing 26 is heat shrunk over the outer layer 24 of the handle 10 to provide an improved handle as well as a protective layer for the hands. In the preferred form of the invention the PVC tubing is approximately 0.020" in thickness.

As discussed above, the new and improved handle is light weight, relatively inexpensive, has exceptional handing strength and provides a protective surface for the user of the equipment to which the handle is attached.

Although the preferred embodiment of the invention has been described, I contemplate that changes may be made without departing from the scope or spirit of the invention, and it is desired to be limited only by the scope of the claims.

I claim:

1. A handle for a piece of equipment comprising: a core member, a plurality of fiberglass strands surrounding said core and extending longitudinally thereof and a PVC tube heat shrunk around and contiguous with said fiberglass strands.

2. The handle of claim 1 wherein said core is molded styrene.

* * * * *